US006590185B2

(12) United States Patent
Kasimirski et al.

(10) Patent No.: US 6,590,185 B2
(45) Date of Patent: Jul. 8, 2003

(54) GLOW PLUG WITH A UNIFORMLY HEATED CONTROL DEVICE

(75) Inventors: Hans-Peter Kasimirski, Ludwigsburg/Ossweil (DE); Paul Bauer, Steinheim (DE); Michael Haussner, Benningen (DE)

(73) Assignee: Beru AG, Ludwigsburg (DE)

( * ) Notice: Subject to any disclaimer, the term of this patent is extended or adjusted under 35 U.S.C. 154(b) by 75 days.

(21) Appl. No.: 09/933,816

(22) Filed: Aug. 22, 2001

(65) Prior Publication Data

US 2002/0023910 A1 Feb. 28, 2002

(30) Foreign Application Priority Data

Aug. 22, 2000 (DE) ..... 100 41 289

(51) Int. Cl.[7] ..... F23Q 7/00
(52) U.S. Cl. ..... 219/270; 123/145 A
(58) Field of Search ..... 219/270, 544, 219/539; 123/145 A, 145 R

(56) References Cited

U.S. PATENT DOCUMENTS 4,556,781 A * 12/1985 Bauer ..... 219/270
5,091,631 A * 2/1992 Dupuis et al. ..... 219/270
5,172,664 A * 12/1992 Mueller et al. ..... 123/145 A
5,880,433 A 3/1999 Eller et al.
6,274,853 B1 * 8/2001 Watanabe et al. ..... 219/538

FOREIGN PATENT DOCUMENTS

| | | | |
|---|---|---|---|
| DE | 3911506 | * 10/1990 | |
| DE | 4029185 | * 3/1992 | ..... 219/270 |
| EP | 392 180 | 10/1990 | |
| GB | 2 136 504 | 9/1984 | |
| JP | 6-300262 | * 10/1994 | ..... 219/270 |

* cited by examiner

*Primary Examiner*—John A. Jeffery
(74) *Attorney, Agent, or Firm*—Nixon Peabody LLP; David S. Safran

(57) ABSTRACT

Glow plug with a glow tube into which an inner pole projects and which is connected via heating and control spirals to the glow tube, the control spirals being located with respect to the heating spirals such that they are uniformly heated over a major portion of their length by the heat from the heating spirals.

9 Claims, 4 Drawing Sheets

GLOW PLUG WITH A UNIFORMLY HEATED CONTROL DEVICE

BACKGROUND OF THE INVENTION

1. Field of the Invention

The present invention relates to a glow plug with a glow tube into which an inner pole projects and which is connected via heating and control spirals to the glow tube.

2. Description of Related Art

In conventional glow plugs, heating and measurement spirals are arranged in a series connection in succession, with the heating spiral being located in the forward area of the glow pin. The heating spiral is connected via a control spiral to the inside pole of the glow plug. The control spiral consists of a material which has a positive or a negative temperature coefficient of resistance, so that in this way self-regulation of the glow current for the heating element takes place, by which overheating of the heating element is avoided.

The control behavior of the control element is influenced, in addition to heating by the flowing current, by the heat radiation of the series-connected heating element. This heat passage from the heating spiral to the control spiral via a wire connection or via the spiral vicinity, however, requires a certain time and takes place nonuniformly from the direction of the heating spiral. This results in a delayed and nonuniform effect on the control behavior of the control spiral; this can lead to the heating spiral's melting through.

SUMMARY OF THE INVENTION

A primary object of the present invention is to provide a glow plug in which the control spiral is influenced more uniformly and promptly by the temperature of the heating spiral, and thus controlled, and the heating spiral being made as a measurement spiral for control of supply of the glow current.

This object is achieved by locating the control spirals with respect to the heating spirals so that the control spirals are uniformly heated by the heating spirals over a majority of their length.

DETAILED DESCRIPTION OF THE PREFERRED EMBODIMENTS

Figure 1:
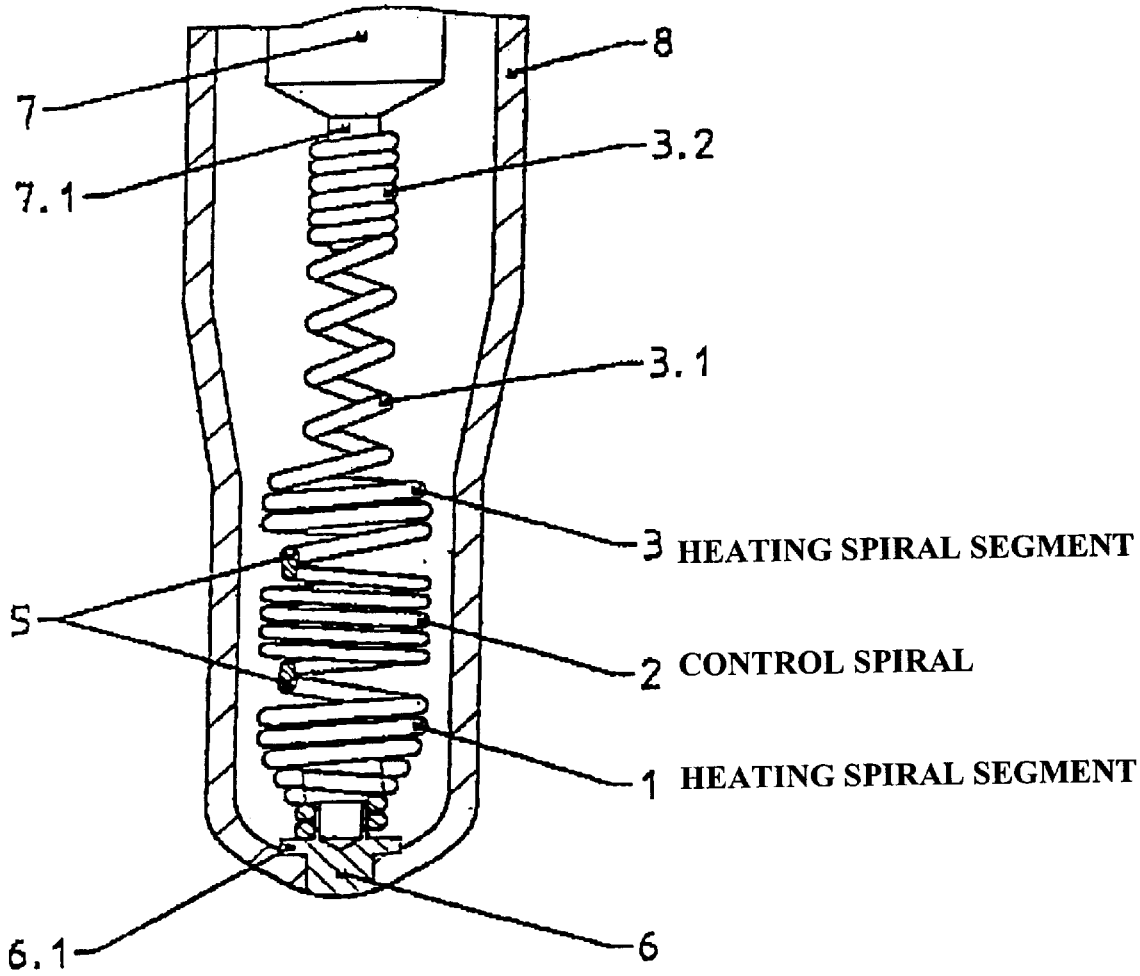
FIG. 1 shows a schematic lengthwise section through the forward area of the glow tube of one embodiment of the glow plug in accordance with the present invention.

As shown in FIG. 1, in a first embodiment of the glow plug in accordance with the present invention, an inner pole 7 projects into a glow tube 8, the glow tube 8 being tapered diametrically at a distal tip area. On a turn 7.1 of the inner pole 7, the block winding 3.2 of the heating spiral 37, which passes into a prolate area 3.1 of the heating spiral 3, is electrically connected via a welding process or crimping to the inner pole. The prolate area 3.1 is used as thermal decoupling between the inner pole 7 and the actual heating spiral 3 with a larger spiral diameter; the heating spiral 3 with the larger diameter, by which the heating spiral turns are located in close proximity to the wall of the glow tube 8, is connected by a weld 5 to the control spiral 2 which can act in the conventional manner also as a measurement spiral 2. The measurement spiral 2 is connected via another weld 5 to the heating spiral 1 in the tip area of the glow tube 8. The turn 7.1 of the inner pole 7 is preferably provided with a peripheral groove in which the last terminal-side turn of the block winding 3.2 is supported.

The heating spiral, in turn, is fixed on the contact pin 6 in the tip of the glow tube 8. The contact pin 6 has a lengthwise stop 6.1 and is used in the axial direction as a boundary, by which a defined length for welding, such as WIG welding, results. In addition, the shoulders 6.1 prevent shooting-through during laser welding.

Preferably, the heating spirals 1, 3, which are hereinafter called the heating spiral segments 1, 3, are made essentially identical with respect to their spiral geometry (number and diameter of the wire and turns) in the area of the weld 5 in order to ensure bilaterally identical heat transport into the control spiral 2. Preferred materials for the heating spiral segments 1, 3 are wires of CrA1255 (KANTHAL™) heat conductor material. However, any other heat conductor material which changes its resistance value only a little or not at all depending on the temperature is well suited.

The material of the control spiral 2 has positive or negative temperature coefficients of resistance and is made, for example, of Ni 99.9 or CoFe, CoFe having a higher control factor than Ni 99.9, and thus, leads to a better measurement signal when using the control spiral as the measurement spiral. However, any other material which changes its resistance value over temperature is also well suited.

Figure 2:
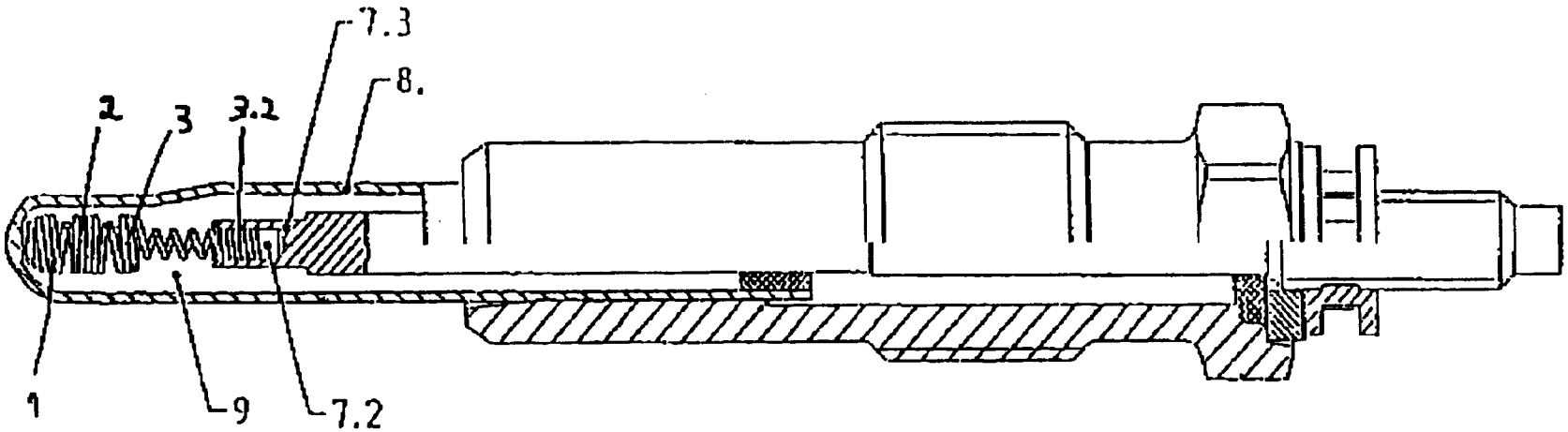
FIG. 2 shows a schematic side view, in a partial lengthwise section, of another embodiment of the glow plug in accordance with the present invention as shown in FIG. 1.

In an embodiment as shown in FIG. 2 which otherwise corresponds to FIG. 1, for further thermal decoupling from the heating/control area, there is a diameter reduction 7.3 of the projection and the inner pole 7 whereby the terminal-side end of the heating spiral segment 3.2 is fixed in a hole 7.2 of the projection. Contact is made directly with the tip of the glow tube, therefore, without the contact piece 6 as shown in FIG. 1.

Figure 3:
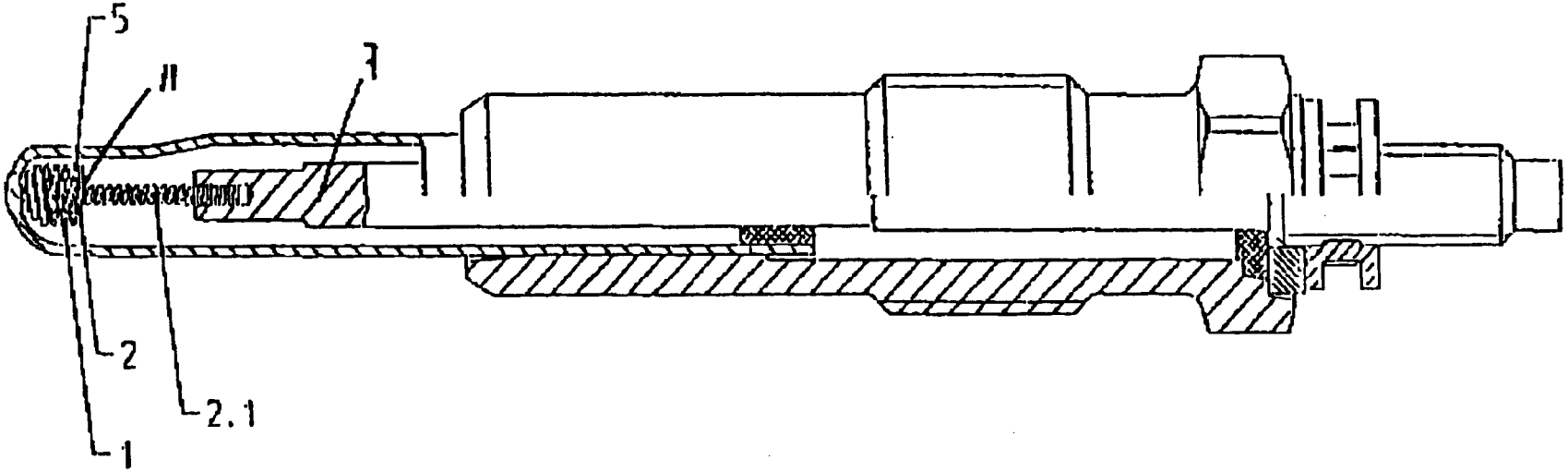
FIG. 3 shows a schematic side view, in a partial lengthwise section, of another embodiment of the glow plug in accordance with the present invention.

Another embodiment of the glow plug in accordance with the present invention is shown in FIG. 3, in which the heating spiral 1 and the control spiral 2 are series connected and welded to one another at 5. In this embodiment, a significant area of the length of the control spiral 2 is pushed into the heating spiral 1 of a larger spiral diameter. This area is large enough to be influenced in a defined manner by the in-flowing heat from the surrounding heating spiral 1 with respect to its control behavior and is considered the essential area of the length of the measurement spiral 2. Preferably, in this approach, between the heating spiral 1 and the control spiral 2, a tube segment 11 which insulates the two from one another can be pushed. The control spiral area 2.1 which establishes the connection to the inner pole 7 is made as a prolate spiral for thermal decoupling from the control/heating area and the inner pole. Contact is made directly with the tip of the glow tube, therefore, without the contact piece 6 as shown in FIG. 1.

Figure 4:
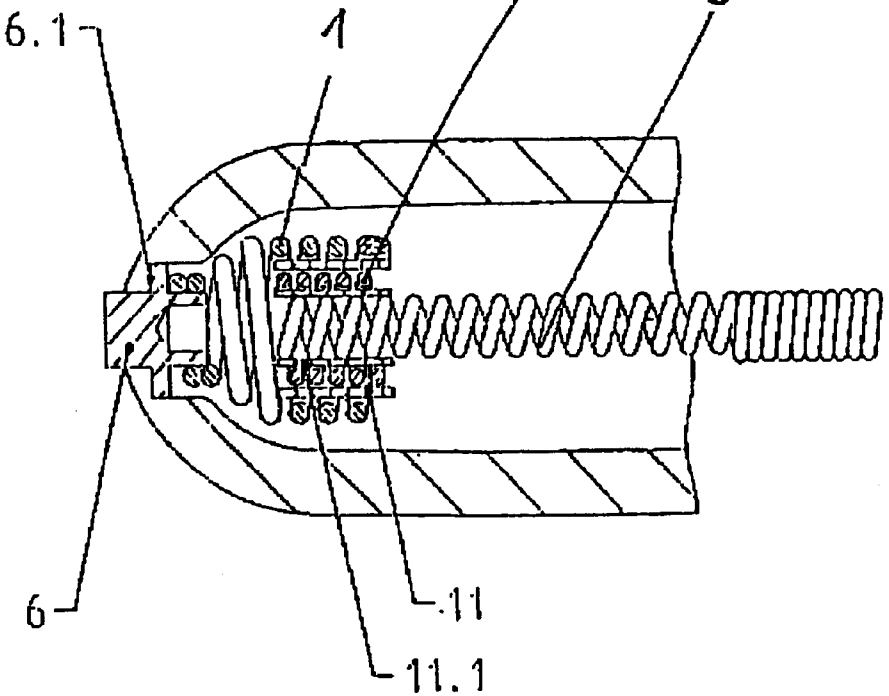
FIG. 4 shows a lengthwise section through the tip of the glow tube of another embodiment of the glow plug in accordance with the present invention.

FIG. 4 shows an approach in which a heating spiral segment 1, a control spiral 2 and a heating spiral segment 3 are series connected. However, all three spirals are pushed into one another, optionally, insulated from one another by insulating tubes 11, 11.1.

Figure 5:
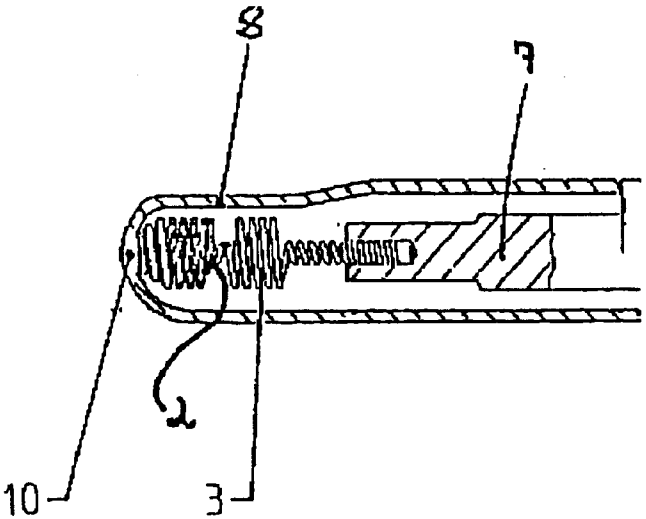
FIG. 5 shows a side view, in a partial lengthwise section, of another embodiment in accordance with the present invention.

The approach in accordance with the present invention as shown in FIG. 5 corresponds to the embodiment shown in FIG. 1 to the extent that the heating and control element is likewise made in three-parts as a heating spiral segment 1, a control spiral 2 and a heating segment 3. However, as in the embodiment shown in FIG. 3, the control spiral 2 is pushed into the heating spiral segment 1. Preferably, the heating spiral segment 1 is fixed in the tip of the glow tube with the weld 10; in addition the tip of the glow tube can have a reduced area 13.1. The inner pole 7 is sealed by an O-ring 12 relative to the glow tube 8. Between the inner pole 7 and the body 14 is an annular body seal 15, and between the housing 14 and the terminal sleeve 17 with the glow plug terminal 18 is an insulating washer 16.

The suggested approaches, especially the preferred approaches, in which the control spiral in a manner in accordance with the present invention is adjacent to one or two heating spiral areas ensures that the control spiral 2 changes its temperature, and thus, its resistance almost simultaneously and uniformly over the length of its region. This is essential for control with the temperature of the heating spiral segment 1 or the heating spiral segments 1 and 3. The change in the resistance of the control spiral is processed as a control signal in the control device or in the control electronics of the glow plug in order to directly increase or decrease energy supply so that the control times can be clearly reduced without unwanted overheating of the heating spiral(s) occurring, with which in general the service life of these plugs is prolonged. In accordance with the present invention, heat-up times of roughly 2 seconds to 1000° C. can be achieved. The glow plugs in accordance with the present invention are especially advantageous in the conventional version as ion measurement plugs, especially as ion measurement plugs with integrated electronic circuitry in the terminal-side plug body area.

What is claimed is:

1. A glow plug comprising:

a glow tube;

an inner pole which axially projects into the glow tube;

a heating device electrically connected in series to the inner pole; and a control device connected in series to said heating device, wherein said control device is connected to said heating device, wherein the heating device is thermally decoupled from the inner pole and connected to said control device such that the control device is uniformly heated over a major portion of its length by heat from the heating device.

2. Glow plug as claimed in claim 1, wherein said heating device comprises a first section and a second section.

3. Glow plug as claimed in claim 2, wherein said control device is disposed between said first section and said second section of said heating device.

4. Glow plug as claimed in claim 2, wherein said first section of said heating device surrounds a major portion of the length of said control device and said control device surrounds said second section of said heating device.

5. Glow plug as claimed in claim 4, wherein the control device comprises a material having a positive or negative temperature coefficient of resistance.

6. Glow plug as claimed in claim 5, wherein said material comprises Ni 99.9 or CoFe.

7. Glow plug as claimed in claim 4, wherein said first section and said second section of said heating device comprise a heat conducting material which changes its resistance value little or not at all depending on temperature.

8. Glow plug as claimed in claim 7, wherein said heat conducting material comprises CrA1255.

9. Glow plug as claimed in claim 1, wherein said control device is surrounded over a major portion of its length by said heating device.

* * * * *